US005447311A

United States Patent [19]

Viollaz et al.

[11] Patent Number: 5,447,311

[45] Date of Patent: Sep. 5, 1995

[54] IRON TYPE GOLF CLUB HEAD

[75] Inventors: Francois Viollaz, Evian; Robert Maestri, Alby sur Cheran, both of France

[73] Assignee: Taylor Made Golf Company, Inc., Carlsbad, Calif.

[21] Appl. No.: 304,204

[22] Filed: Sep. 12, 1994

Related U.S. Application Data

[63] Continuation of Ser. No. 89,098, Jul. 12, 1993, abandoned.

[30] Foreign Application Priority Data

Jul. 10, 1992 [FR] France ..... 92 08821

[51] Int. Cl.[6] ..... A63B 53/04

[52] U.S. Cl. ..... 273/173; 273/78

[58] Field of Search ..... 273/173, 167 H, 78, 273/DIG. 23

[56] References Cited

U.S. PATENT DOCUMENTS

| | | | |
|---|---|---|---|
| 4,539,253 | 9/1985 | Hirschbuehler et al. | 273/DIG. 23 X |
| 4,792,140 | 12/1988 | Yamaguchi et al. | 273/173 |
| 4,798,383 | 1/1989 | Nagasaki et al. | 273/173 X |
| 4,809,978 | 3/1989 | Yamaguchi et al. | 273/173 X |
| 4,884,812 | 12/1989 | Nagasaki et al. | 273/173 X |
| 5,184,823 | 2/1993 | Desboilles et al. | 273/167 H X |

FOREIGN PATENT DOCUMENTS

| | | | |
|---|---|---|---|
| 0000968 | 1/1993 | WIPO | 273/167 H |

*Primary Examiner*—Raleigh W. Chiu

*Attorney, Agent, or Firm*—Pollock, Vande Sande & Priddy

[57] ABSTRACT

Golf club head of the "iron" type, comprising a head body constituted by a shell (3) formed by a series of metal walls (9,10, 11) forming an inner cavity (4). The front wall (9) belonging to the series of metal walls is (AR) in relation to the hitting plane (P) in order to house a hitting wall (7) made of plastic or composite material.

11 Claims, 4 Drawing Sheets

IRON TYPE GOLF CLUB HEAD

This application is a continuation of application Ser. No. 08/089,098 filed Jul. 12, 1993, now abandoned.

FIELD OF THE INVENTION

The present invention relates to golf club head, and, more specifically, an improvement made to a head incorporating a mounted hitting surface.

BACKGROUND OF THE INVENTION

When the game of golf is played, the player strikes the ball in order to move it, by driving it with a tool called a golf club, which is constituted by a shaft comprising a head at its lower end, while its upper end is equipped with a handle, commonly called a "grip."

To play golf, the player has a certain number of clubs, each different from the other. At the outset, the player uses a club called a "wood," while succeeding strokes are played using a club called an "iron." This name derives from the fact that the heads of the irons have always been made of a steel mass.

Each manufacturer gives its products a specific shape, while adhering to a certain number of rules required for official sanctioning of these clubs in competition. Accordingly, certain dimensions, slopes, and weights are officially required, while a large number of other parameters can be freely determined. For this reason, there exists a considerable diversity of products incorporating totally different designs.

Clubs currently being marketed have heads which appear to be satisfactory solely by virtue of their aesthetics, an aspect to which manufacturers have devoted particular care. However, during use the player very quickly understands that they pose a number of difficulties. For example, their low "forgiveness" level and the unpleasant sensation felt by the player on impact will be noted. In this regard, U.S. Pat. No. 4,582,321 describes a golf club head with a complex structure of the type in which the metal blade is covered by, and, more precisely, enclosed in, a jacket made of a composite material.

SUMMARY OF THE INVENTION

The present invention proposes the solve the aforementioned problems by suggesting an "iron"-type golf club head which provides improved performance at the time of impact, especially for long-distance irons. Among other features, this head makes it possible to modify the sensation experienced upon hitting the ball, while preserving a conventional weight distribution. Furthermore, the design of the front wall of the head makes it possible to the thickness of the front metal wall thereby making it possible for a head of a given weight to incorporate transferable weight that can be distributed elsewhere.

To this end, the golf club head comprises a head body consisting of a series of metal walls forming an internal cavity the front wall of this set of metal walls being shifted rearward in relation to the hitting plane, so as to receive a hitting wall made of a plastic or composite material, characterized by the fact that this head is an "iron" whose internal cavity has the general shape of a triangle, as seen in cross-sections along planes perpendicular to the hitting plane.

In a preferred configuration, the hitting wall is glued to the front face of the front wall, so that the hitting face of the hitting wall falls substantially within the hitting plane.

According to a complementary characteristic, the front wall of the set of metal walls comprises a recess in which the hitting wall is fitted.

According to a preferred arrangement, the wall-fitting recess has a peripheral edge used to hold the hitting wall in position, this edge having a front peripheral surface positioned substantially in the plane of the hitting face.

According to a special configuration, the front wall has a thickness of between 1 and 3 millimeters, while the hitting wall has a thickness of between 1 and 4 millimeters.

The hitting wall is produced, for example, by stacking several woven sheets of resin-impregnated carbon and/or aramid fibers.

BRIEF DESCRIPTION OF THE DRAWINGS

Other features and advantages will become evident from following description provided with reference to the attached drawings, in which:

FIG. 8 is a cross-section similar to that in FIG. 4.

FIG. 9 is a perspective view similar to FIG. 5.

DESCRIPTION OF THE PREFERRED EMBODIMENT

Figure 1:
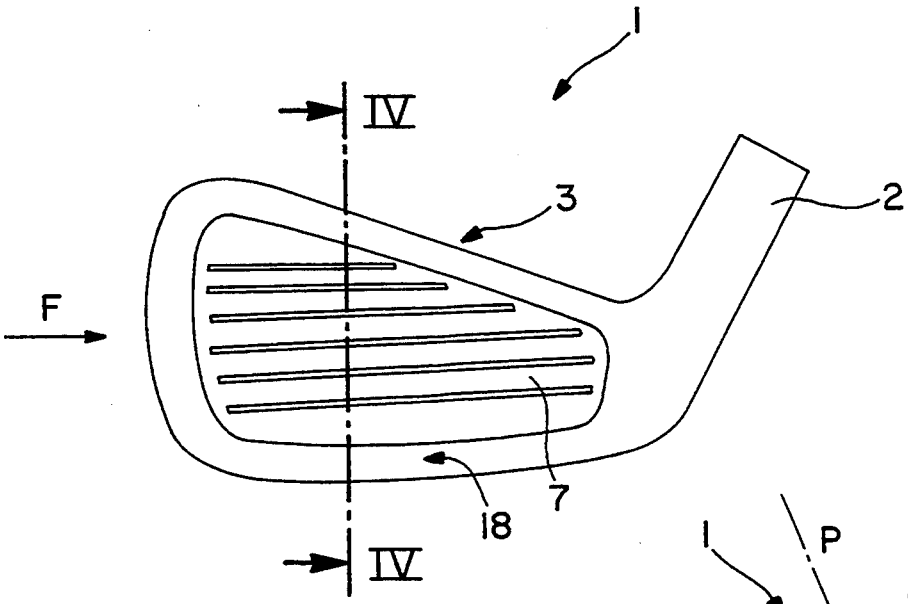
FIG. 1 is a front view of a golf club head according to the invention.
Figure 2:
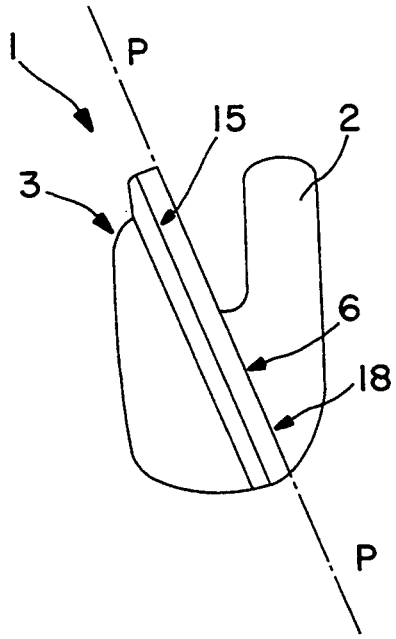
FIG. 2 is a side view in the direction of arrow F in FIG. 1.
Figure 3:
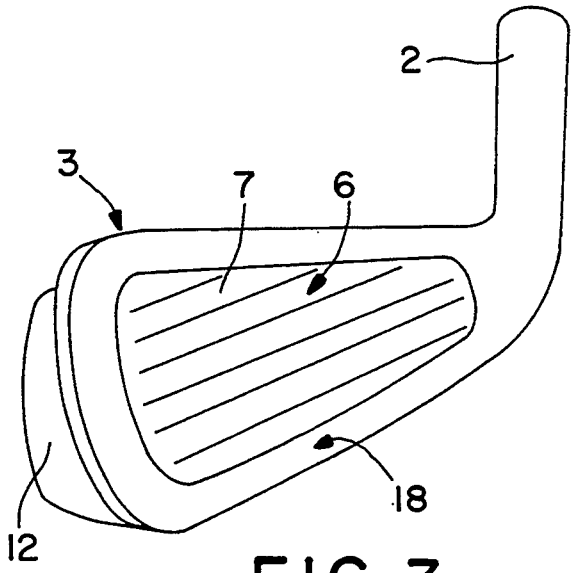
FIG. 3 is a perspective view.
Figure 4:
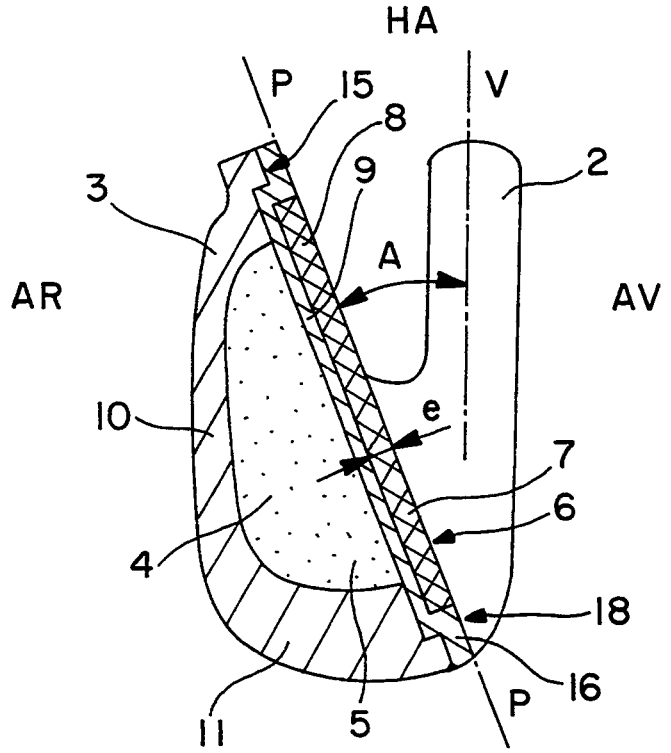
FIG. 4 is a cross-section along line IV—IV in FIG. 1.
Figure 5:
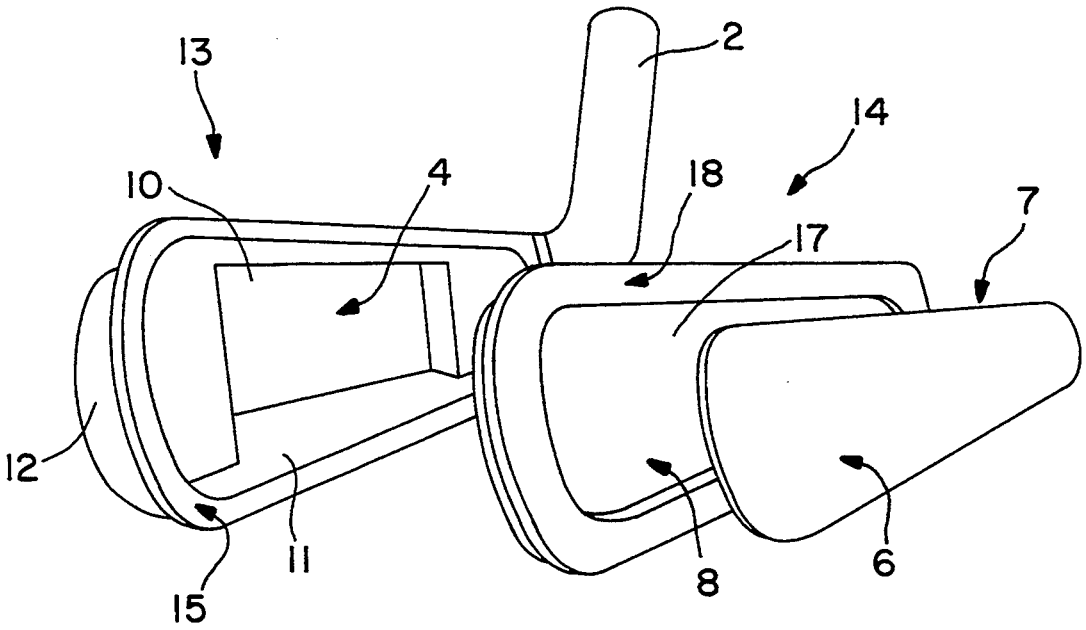
FIG. 5 is an exploded view showing the various components separately.

The golf club head according to the invention and illustrated as an example comprises, in conventional fashion, the body of the head 1 extended laterally by a neck 2 extending laterally and upward. This neck 2 has the general shape of a cylindrical tube, so as to allow the lower end of the club shaft to be inserted into it.

The head body 1 consists, for example, of a series of metal walls which thus form a hollow metal shell 3 whose internal cavity 4 is advantageously filled with a low-density filling material 5 such as a foam and, for example, a polyurethane foam.

Thus, the metal shell 3 consists of a front wall 9 and a rear wall 10 extended downward by a lower wall 11, and laterally and toward the outside by a lateral outer wall 12. The shell is advantageously produced in two parts or elements, a rear element 12 and a front element 14. This rear element is a one-piece element and is, for example, molded with the neck 2. It comprises the rear wall 10, the lower wall 11, and the lateral outer wall 12 so as to form an internal cavity 4 delimited peripherally and toward the front AV by a peripheral support shoulder 15.

According to a preferred configuration, the front element 14 is produced separately and forms the front wall 9 of the body of the head. This front element 14 is, for example, made of steel and is welded peripherally to the front of the rear element 13. It consists of a central support wall which seals the cavity and forms the front wall 9 of the shell 3. Moreover, it comprises a peripheral edge 16 so arranged that the front face 8 of the front wall 9 is recessed toward the rear in relation to the front peripheral surface 18 of the peripheral edge 16, so as to form a recess 17 into which the hitting wall 7 is fitted, this recess having the shape and dimensions of the hitting wall. The front face 8 is thus positioned behind the plane P and at a distance "e" substantially equal to the thickness of the hitting wall 7. The plane P contains the front peripheral surface 18 of the peripheral edge 16. This plane extends upward (HA) and rearward (AR) and substantially corresponds to the plane of the hitting surface 6. This plane thus slopes rearward by an angle A formed with the vertical V.

According to one feature of the invention, the hitting surface 6 comprises the front face of a separate hitting wall 7 made of a composite material and attached, for example by gluing or welding, to the front face 8 of the front wall 9 of the shell 3 of the head body 1. The hitting wall is advantageously flat and of uniform thickness "e."

The composite material may be woven sheets of carbon and/or aramid fibers impregnated with a thermoplastic or thermosetting resin. Preferred fibers include long carbon fibers of high mechanical strength and having a modulus of elasticity may range from 230 to 590 GPa, and a rupture strength of between 2,450 and 7,000 MPa. These values are greater than those of the steels conventionally used. The matrices or resins may be polyphenylene sulfide (PPS), polyether imide (PEI), polyether-ether-ketone (PEEK), or epoxy.

The hitting wall 7 is preferably made by stacking multiple woven sheets of fibers, for example two-directional sheets. The specific orientation of the fibers composing each woven sheet is shown by way of example in FIG. 7. In this embodiment, the wall comprises first sheets (20, 21, 22, 23, 24) whose fibers are oriented, on the one hand, along the horizontal axis (X–X′) and, on the other hand, along the vertical axis (Y–Y′). The wall also comprises second sheets (25, 26, 27, 28, 29) which are offset by +45° and −45° in relation to the horizontal axis (X–X′). Preferably, the wall comprises a successive stack of from 10 to 25 sheets of fibers 20, 25.

Figure 6:
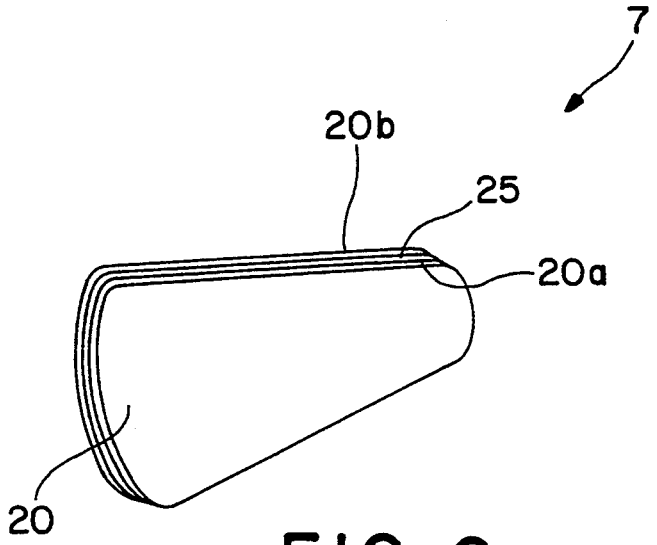
FIG. 6 is a perspective view of the hitting wall.
Figure 7:
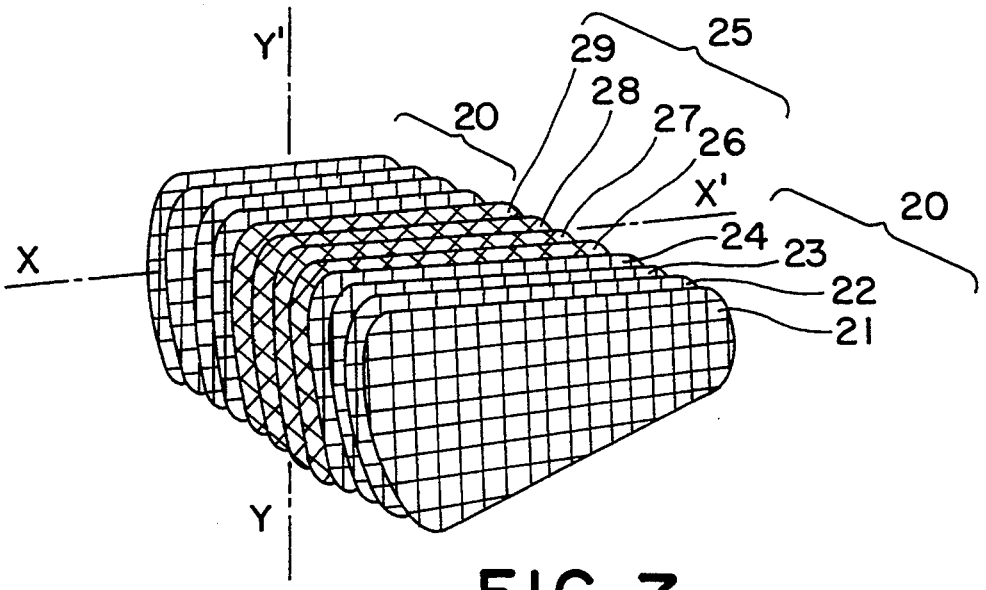
FIG. 7 is a perspective detail view showing how the hitting face is produced.

FIGS. 6 and 7 shows an especially advantageous sequence of first sheets 20 and second sheets 25 for optimizing the strength of wall 7. The wall thus comprises a sequence composed of a first outer layer **20*a* of first sheets 20, in which the fibers are oriented along the axes X–X′ and Y–Y′, of a second intermediate layer composed of second sheets 25 whose fibers are oriented at +45° and −45° to the axis X–X′, and a third, inner layer 20*b* composed of first sheets 20** whose fibers are oriented along the axes X–X′ and Y–Y′. The second intermediate layer comprises between approximately 3 and 9 sheets.

The first, outer layer **20*a* is designed to withstand compression stresses resulting from the impact of the ball, and the third, inner layer 20*b* is designed to resist tractive stresses. The stresses are directed principally along the axes X–X′ and Y–Y′. The second, intermediate layer 25** is designed to withstand shear stresses occurring on the neutral fiber, which is basically oriented at +45° and −45° in relation to the axis X–X′.

An embodiment of a strong wall 7 made of a composite material and its mechanical characteristics be described.

The wall consists of a stack of sheets woven in balanced fashion from carbon fibers and epoxy resin. The quantitative proportion of fibers/resin is 1. The thickness of a sheet is 0.2 mm. The fibers have a modulus of elasticity of 230 GPa and a rupture strength of 4,410 MPa (T300J fibers made by TORAY).

The stack is composed of the first outer layer **20*a* consisting of six woven fiber sheets oriented along the axes X–X′ and Y–Y′ (called "0°, 90°" orientation), of the second, intermediate layer 25 consisting of five woven fiber sheets oriented at +45° and −45° to the axis X–X′, and of the third inner layer 20*b*** of six woven fiber sheets oriented at 0° and 90°.

It has been found that a construction comprising a second, intermediate layer of three fiber sheets or less only at the level of the neutral fiber does not sufficiently withstand the impact of the ball and produces breakage of the wall 7. This rupture phenomenon is also observed in a construction comprising a second, intermediate layer of nine or more woven sheets whose fibers are oriented at +45° and −45°, which partially replace woven sheets whose fibers are oriented at 0° and 90°.

The hitting surface 6 is conventionally flat and is disposed in plane P extending upward (HA) and rearward (AR). According to the invention, the front metal wall 9 of the shell 3 of the head body 1 is shifted rearward in relation to the plane P distance "e" equal to the thickness of the hitting wall. In this configuration, the weight in the front of the head is moved backward, thereby making the use of the club more "forgiving." Furthermore, the combination in the front part of the head of the front wall 9 and the hitting surface 6 allows manufacture of a head in which the thickness of the metal front wall 9 can be appreciably reduced, thereby making it possible, in a head of a given weight, to incorporate transferable weight which may be distributed elsewhere.

Figure 8:
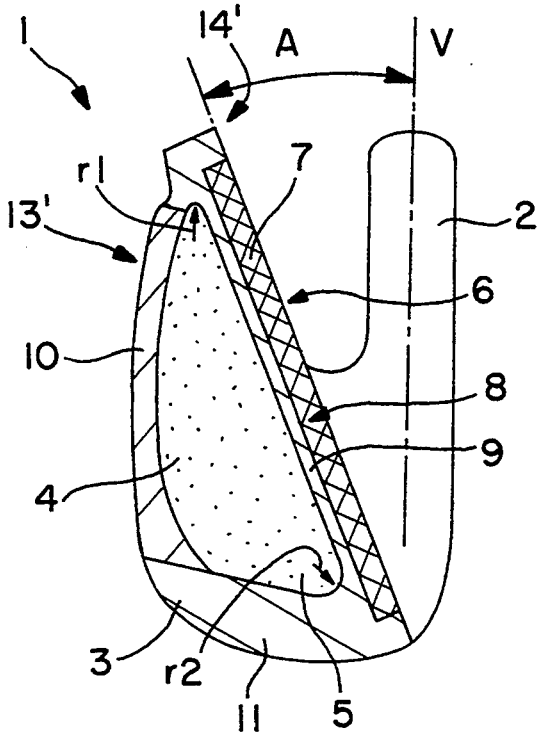
FIGS. 8 and 9 illustrate a variant.
Figure 9:
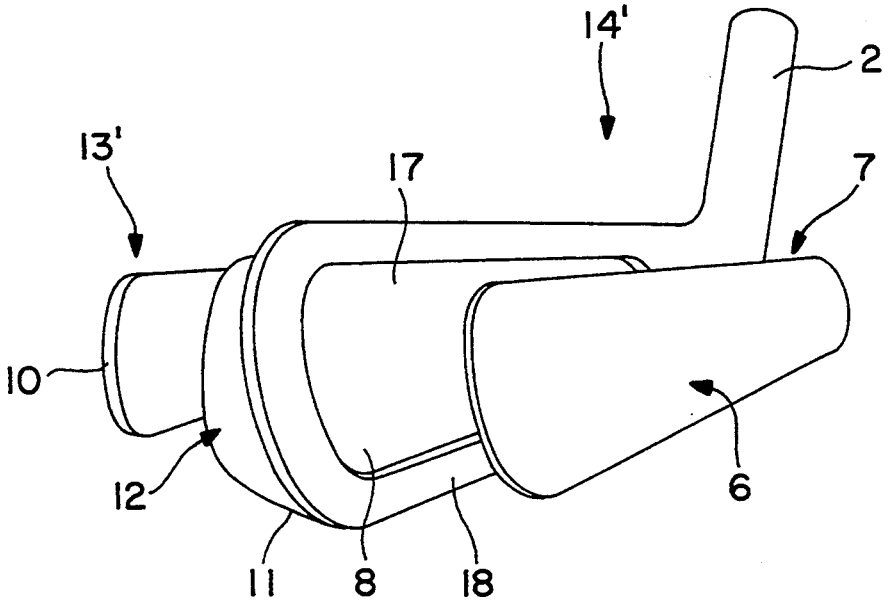

FIGS. 8 and 9 illustrate an embodiment in which the front wall is molded with the shell instead of being mounted on it, as in the preceding embodiment. Thus, it is the rear wall which is mounted on the shell in order to seal the inner cavity and thus allow the shell to be molded. To enhance understanding of FIGS. 8 and 9, components analogous to those in the preceding embodiment bear the same reference numbers. This embodiment will, therefore, not be described in detail. It should be noted, however, the head body 1 thus consists of a series of metal walls forming a hollow metal shell 3, whose inner cavity 4 is advantageously filled with a filling material 5 such as a foam and, for example, a polyurethane foam. This metal shell 3 is constituted by a front wall 9 and a rear wall 10 extended downward by a lower wall 11, and laterally and to the outside by an outer lateral wall 12. The shell is advantageously made in two parts, or elements, a rear element 13′ and a front element 14′. The front element is a one-piece element which may be molded with the neck 2 and which consists of the front wall 9, the lower wall 11 and the outer lateral wall 12 so as to form the inner cavity 4 open to the rear and then resealed by the rear wall 10, for example, welding.

As previously described, the front wall comprises a peripheral edge 16 arranged so that the front face 8 of the front wall 9 is recessed rearward in relation to the front peripheral surface 18 of this peripheral edge 16, in order to form a recess 17 into which the hitting wall 7 is fitted. This recess has the shape and dimensions hitting wall. The front surface 8 is thus positioned behind the plane P and at a distance "e" substantially equal to the thickness of the hitting wall 7. The plane P contains the front peripheral surface 18 of the peripheral edge which extends, upward (HA) and rearward (AR) and substantially corresponds to the plane of the hitting surface 6. Moreover, and as previously described, the hitting surface 6 is constituted by the front face of a hitting wall 7 made of a composite material and attached, for example by gluing or welding, to the front face 8 of the front wall 9 of the shell 3 of the head body 1. The hitting wall 7 is advantageously flat and of uniform thickness "e," and is, a separate part made of a composite material and of substantially uniform thickness "e." The hitting wall is mounted on the front face 8 of the front wall 9 by welding, screws, or any other means.

According to advantageous arrangements, the thickness of the hitting wall 7 is between 1 and 4 mm, preferably 2 to 4 mm, and the thickness of the front wall 9 of the jacket is between 1 and 3 mm, preferably 2 to 4 mm. The reinforcing piece making up the hitting wall may be of any type, and especially of the woven or unwoven type. The front peripheral junction of the cavity and the front wall is formed by a fillet. The upper fillet has a radius r1, which is smaller than the radius r2 of the lower fillet (FIG. 8); r1 may be 3 millimeters, and radius r2, 5 millimeters.

What is claimed is:

1. Golf club head of the "iron" type comprising a head body (1) comprising a set of metal walls (9, 10, 11, 12) forming a shell (3) completely enclosing an interior cavity (4), a front wall (9) of said set of metal walls being recessed in relation to a hitting plane (P) and housing a hitting wall (7) made of a plastic or composite material and constituting an outer part of said head wherein said inner cavity (4) has a generally triangular shape when viewed in cross-section in planes perpendicular to said hitting plane (P).

2. Golf club head according to claim 1, wherein said hitting wall (7) is attached by means of glue to a central portion of a front face (8) of said front wall (9) and a hitting surface (6) of said hitting wall falls substantially within said hitting plane (P).

3. Golf club head according to claim 2, wherein said front wall (9) incorporates a recess (17) into which said hitting wall (7) fits.

4. Golf club head according to claim 3, wherein said fitting recess (17) comprises a peripheral edge (16) which holds said hitting wall in place.

5. Golf club head according to claim 4, wherein said peripheral edge (16) comprises a front peripheral surface (18) disposed substantially in the plane (P) of said hitting surface (6).

6. Golf club head according to claim 1, wherein said front wall (9) has a thickness of between 2 and 3 millimeters.

7. Golf club head according to claim 6, wherein said hitting wall (7) has a thickness of between 2 and 4 millimeters.

8. Golf club head according to claim 1, wherein said hitting wall (7) is composed of a stack of multiple sheets woven of resin-impregnated carbon and/or aramid fibers.

9. Golf club head according to claim 1, wherein said shell (3) is constituted by a rear element (13) and a front element (14).

10. Golf club head according to claim 9, wherein said rear element (13) comprises a rear wall (10) and a lower wall (11), while a front element (14) comprises said front wall (9).

11. Golf club had according to claim 10, wherein said rear element (13) is extended laterally and upward by a neck (2).

* * * * *